United States Patent [19]

Mitchell et al.

[11] 4,150,320

[45] Apr. 17, 1979

[54] INTEGRAL LENS CATHODE RAY TUBE SYSTEM

[75] Inventors: Robert B. Mitchell; John P. O'Donnell, both of Seneca Falls; Harry R. Swank, Waterloo, all of N.Y.

[73] Assignee: GTE Sylvania Incorporated, Stamford, Conn.

[21] Appl. No.: 816,504

[22] Filed: Jul. 18, 1977

[51] Int. Cl.[2] ..... H01J 31/00
[52] U.S. Cl. ..... 313/478; 358/250
[58] Field of Search ..... 313/478; 358/237, 250

[56] References Cited

U.S. PATENT DOCUMENTS

| | | | |
|---|---|---|---|
| 2,093,288 | 9/1937 | Ogloblinsky | 358/250 X |
| 2,172,775 | 9/1939 | Schmidt-Ott et al. | 358/237 |
| 2,312,206 | 2/1943 | Calbick | 313/478 X |
| 3,130,854 | 4/1964 | Casciari | 220/2.1 |
| 3,708,622 | 1/1973 | Brown et al. | 350/276 SL X |
| 3,909,524 | 9/1975 | Ohkoshi et al. | 313/473 X |

*Primary Examiner*—Robert Segal
*Attorney, Agent, or Firm*—Thomas H. Buffton

[57] ABSTRACT

An integral lens cathode ray tube system includes a cathode ray tube having an electron gun for providing a visual display on a substantially spherical-shaped viewing portion and a glass panel affixed to the viewing portion by a resin disposed therebetween and optically matched to the glass panel and viewing portion of the cathode ray tube.

2 Claims, 2 Drawing Figures

INTEGRAL LENS CATHODE RAY TUBE SYSTEM

BACKGROUND OF THE INVENTION

The most common and well-known form of cathode ray tube includes an electron gun for providing a visual display on a substantial rectangular viewing portion of a cathode ray tube. The viewing portion of the cathode ray tube is usually substantially spherical-shaped with a convexo concave configuration. As a result, the visual display of the cathode ray tube directed onto a flat surface tends to have a significant amount of de-focusing at the corners of the display.

In order to utilize the common form of cathode ray tube in a projection TV system for example, it has been required that relatively complex and separate optical components and lens be employed in an effort to reduce or minimize such de-focusing problems. Although such techniques have been and still are employed in such apparatus, it has been found that losses in light output, difficulty of alignment of the system and complexity and costs of the added components and apparatus are factors which tend to deleteriously affect such apparatus.

Additionally, it is known that the viewing portion of a cathode ray tube may be covered by a substantially similar-shaped glass panel to provide implosion protection for a viewer. Moreover, the similarly-shaped viewing portion and glass panel are usually bonded together by an epoxy or polyester resin to provide the desired protective shield. However, the added shield member serves as added protection but does not contribute to the resultant focus capabilities of the structure.

OBJECTS AND SUMMARY OF THE INVENTION

An object of the invention is to provide an enhanced cathode ray tube lens system. Another object of the invention is to improve the visual display capabilities of a cathode ray tube. Still another object of the invention is to provide a lens system for improving the focus capabilities of a substantially spherical-shaped viewing portion of a cathode ray tube. A further object of the invention is to provide an integrated cathode ray tube lens system for enhanced focusing of a visual image on a substantially flat surface.

These and other objects, advantages and capabilities are achieved in one aspect of the invention by a cathode ray tube integral lens system having a cathode ray tube with an electron gun for providing a visual display on a rectangular substantially spherical-shaped viewing portion and a glass panel affixed to the viewing portion by a resin therebetween to form a lens system and enhance the viewing capabilities of the visual display.

DESCRIPTION OF THE PREFERRED EMBODIMENT

For a better understanding of the present invention, together with other and further objects, advantages and capabilities thereof, reference is made to the following disclosure and appended claims in conjunction with the accompanying drawings.

Figure 1:
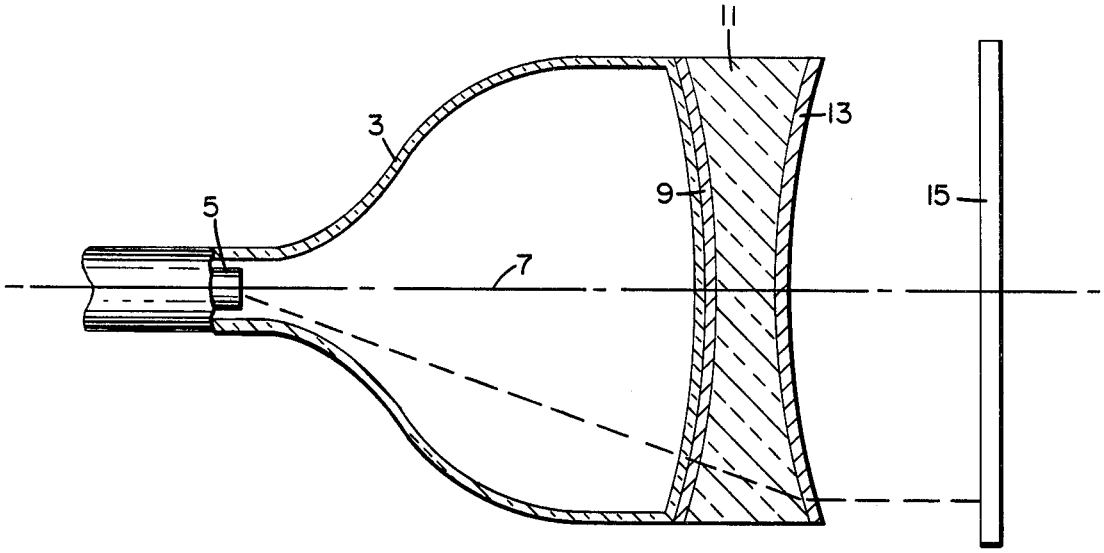
FIG. 1 is an illustration of a preferred form of integrated cathode ray tube lens system especially suitable to a flat visual display.

Referring to the drawings, FIG. 1 illustrates a preferred form of integrated cathode ray tube lens system. Herein, a cathode ray tube 3 includes an electron gun 5 for providing an electron beam 7. The electron beam 7 impinges a viewing portion 9 of the cathode ray tube 3 in a manner to provide a visual display.

The viewing portion 9 of the cathode ray tube 3, in most present-day cathode ray tube structures, is substantially rectangular in shape with a spherical configuration to provide a concave configuration. Thus, electron beams 7 striking the viewing portion 9 normally tend to provide a diverging visual display.

Affixed to the viewing portion 9 of the cathode ray tube 3 by a resin 11 is a glass panel 13. The glass panel 13 is also of a spherical configuration substantially similar to the configuration of the viewing portion 9. Moreover, the glass panel 13 is disposed in a manner related to the viewing portion 9 of the cathode ray tube 3 such that a double concave lens is provided.

Also, the resin 11 intermediate to and affixing the viewing portion 9 and glass panel 13 is optically matched thereto to form a single optical interface. A preferred form of resin is designated Dow Epoxy Resin D.E.H. 720 and Dow Epoxy Hardener 66 and is readily available in the market place. Obviously, other resins which are optically matched and provide a bond are equally applicable to such lens construction. Moreover, the resin itself may be contoured in a manner such that the glass faceplate is no longer necessary.

As can be seen, the double concave lens configuration provides a collimated visual image which is suitable for display on a substantially flat surface 15. Also, the complimentary-shaped glass panel 13 tends to compensate for the substantially spherical-shaped viewing portion 9 of the cathode ray tube 3. As a result, that part of the visual image which appears at the corners of the viewing portion 9 and would normally be divergent and out of focus on a flat surface 15 is corrected by the complimentary contour of the glass panel 13. Thus, a desired focused visual display is provided.

Figure 2:
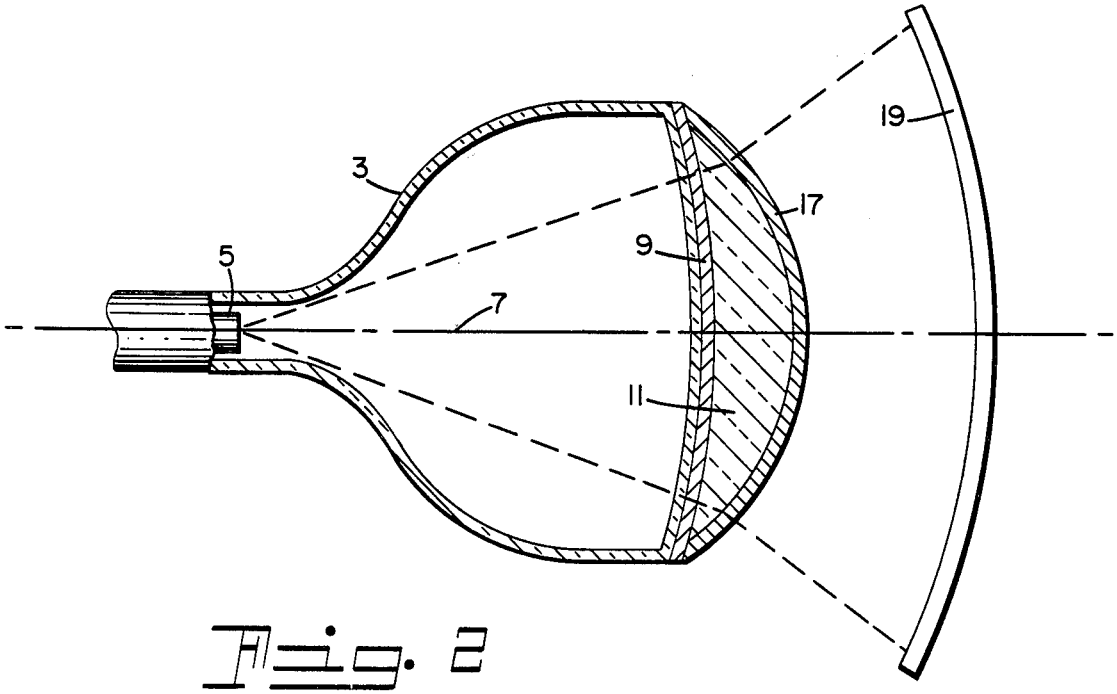
FIG. 2 is an illustration of an alternate form of integrated cathode ray tube lens system.

Alternatively, FIG. 2 illustrates an integrated cathode ray tube lens system employing a cathode ray tube 3 having an electron gun 5 providing an electron beam 7. The electron beam 7 strikes the viewing portion 9 of the cathode ray tube 3 to provide a visual display.

The visual portion 9 is substantially rectangular with a convexo concave configuration and a glass panel 17 is affixed thereto by a resin 11. The glass panel 17 is also convexo concave with a configuration somewhat similar to that of the viewing portion 9. However, the glass panel 17, in this instance, is formed to provide a more divergent display than that provided by the viewing portion 9 of the cathode ray tube 3. Thus, the combined viewing portion 9, resin 11 and convexo concave glass panel 17 serve as a lens system such that the visual display of the cathode ray tube 3 is divergent and suitable for focused presentation on a convexo concave viewing screen 19.

Thus, there has been provided an integral cathode ray tube lens system having numerous advantages over prior known methods. The system utilizes a normal cathode ray tube to provide a visual display which is collimated and in focus on a substantially flat display area. Such a system is especially suitable for projection television wherein light output, component alignment and costs are especially critical. Also, the system permits a surround-type form of visual display on a convexo concave viewing surface wherein divergence of the display is greater than that provided by the cathode ray tube. Moreover, the effect is achieved with good focus capabilities and at a minimum of component cost.

While there has been shown and described what is at present considered the preferred embodiments of the invention, it will be obvious to those skilled in the art that various changes and modifications may be made therein without departing from the invention as defined by the appended claims.

What is claimed is:

1. An integral cathode ray tube lens system suitable for use in a projection television system comprising:

a cathode ray tube having an electron gun for providing a visual display on a substantially rectangular, spherical, and concave-shaped viewing portion; and an optically matched resin adapted to the contour of and affixed to said viewing portion, said resin formed to have a substantially rectangular, spherical, and convex-shaped viewing portion and providing a double concave compensating lens system whereby a visual image is focused on a substantially planar surface.

2. The integral cathode ray tube lens system of claim 1 wherein is included a substantially rectangular, spherical, concave-shaped glass panel disposed in back-to-back relationship with said viewing portion of said cathode ray tube and affixed thereto by said resin, said viewing portion and glass panel forming a double concave compensating lens system.

* * * * *